US005901950A

United States Patent [19]

Kobayashi et al.

[11] Patent Number: 5,901,950

[45] Date of Patent: May 11, 1999

[54] DOCUMENT FEEDING DEVICES FOR IMAGE READING APPARATUS

[75] Inventors: Hiroshi Kobayashi; Masaki Kadota; Masanori Yamaoka; Keiji Ban, all of Osaka, Japan

[73] Assignee: Mita Industrial Co., Ltd., Osaka, Japan

[21] Appl. No.: 08/814,848

[22] Filed: Mar. 11, 1997

[30] Foreign Application Priority Data

Mar. 13, 1996 [JP] Japan ..... 8-085659

[51] Int. Cl.[6] ..... B65H 5/22

[52] U.S. Cl. ..... 271/3.24; 271/273; 271/182

[58] Field of Search ..... 271/3.18, 3.24, 271/273, 182, 314, 4.04, 3.2

[56] References Cited

U.S. PATENT DOCUMENTS 5,463,256 10/1995 Wang et al. ..... 271/273
5,494,271 2/1996 Wun et al. ..... 271/3.01
5,628,503 5/1997 Ishikawa ..... 271/4.1
5,755,435 5/1998 Fujiwara ..... 271/4.04

FOREIGN PATENT DOCUMENTS 362161644 7/1987 Japan ..... 271/4.04

*Primary Examiner*—H. Grant Skaggs
*Attorney, Agent, or Firm*—Jordan and Hamburg

[57] ABSTRACT

A helical gear connected to a lower discharge roller is made movable in its axial direction toward a bracket when a stepping motor is activated. A friction pad formed from felt or sponge rubber, for example, is attached to a side surface of the helical gear that is located face to face with the bracket. When the stepping motor is energized, the helical gear shifts toward the friction pad and the side surface of the helical gear comes in sliding contact with the friction pad. Resultant frictional resistance produces a braking force which acts on the rotating lower discharge roller. An overrun of the lower discharge roller due to a backlash between engaging gears is prevented even when an upper transfer roller exerts a forward-pushing force on a rear end of a sheet of an original document.

11 Claims, 7 Drawing Sheets

DOCUMENT FEEDING DEVICES FOR IMAGE READING APPARATUS

BACKGROUND OF THE INVENTION AND RELATED ART STATEMENT

This invention relates to document feeding devices for image reading apparatus which read an image on each sheet of an original document while feeding it through the apparatus.

A facsimile machine is an example of the image reading apparatus that sequentially reads images on an original document while feeding each sheet of the document at a generally constant speed. The facsimile machine has a pair of upper and lower transfer rollers and a pair of upper and lower discharge rollers provided along a document path in this order. The lower transfer roller and the lower discharge roller are individually connected to a driving motor via a gear-operated transmission mechanism which is composed essentially of a combination of multiple gears. When the driving motor is run, a sheet of the document is conveyed from the transfer rollers toward the discharge rollers. The upper and lower transfer rollers, the upper and lower discharge rollers, the gear-operated transmission mechanism and the driving motor are principal components constituting a document feeding device for feeding each sheet of the document in this facsimile machine. The facsimile machine further incorporates an image reading unit located between the transfer rollers and the discharge rollers for scanning an image on each sheet of the document as it is transported by the document feeding device.

In the facsimile machine thus constructed, the document feeding speed increases momentarily, just before a rear end of a sheet of the document leaves the upper and lower transfer rollers, and then decreases momentarily immediately after the rear end of the sheet has left the upper and lower transfer rollers. The document feeding speed is not kept precisely constant in the conventional facsimile machine as described above. Fluctuation of the document feeding speed causes a deterioration of image reading accuracy, and this is a common problem encountered with the facsimile machine as well as with other image reading apparatus of the prior art.

SUMMARY OF THE INVENTION

It is an object of the invention to provide document feeding devices for image reading apparatus which read images on an original document while feeding each sheet of the document. It is a more specific object of the invention to provide document feeding devices which can feed each sheet of the document at a constant feeding speed.

According to the invention, a document feeding device for an image reading apparatus having an image reader for scanning an image on an original document while it is being transported in a specific feed direction comprises first and second transfer rollers arranged in parallel with each other in mutual contact on an upstream side of the image reader, first and second discharge rollers arranged in parallel with each other in mutual contact on a downstream side of the image reader, a driver serving as a source of driving force for rotating the first transfer roller and the first discharge roller, a gear-operated transmission mechanism including a plurality of gears for transmitting the driving force produced by the driver to the first transfer roller and the first discharge roller, and an anti-rotation brake for exerting a braking force on the first discharge roller.

As will be discussed later in detail, the document feeding device of the invention can effectively suppress adverse effects of a forward-pushing force, or even the forward-pushing force itself, that is exerted on the rear end of each sheet of the original document and makes it possible to feed the document at a constant speed.

These and other objects, features and advantages of the invention will become more apparent upon reading the following detailed description in conjunction with the accompanying drawings.

DETAILED DESCRIPTION OF THE PREFERRED EMBODIMENT OF THE INVENTION

A. Fluctuations in Document Feeding Speed

Figure 1A:
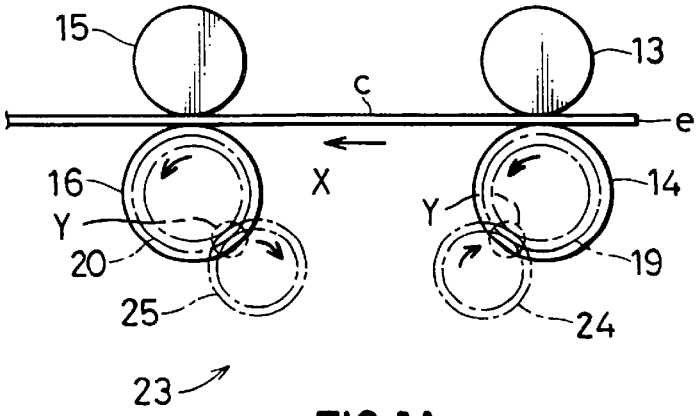
FIGS. 1A and 1B are diagrams illustrating how backlash occurs in a conventional gear-operated transmission mechanism with FIG. 1B being an enlarged view of the area within the broken line circles Y in FIG. 1A.

Discussed below with reference to FIGS. 1A, 1B, 2A and 2B are reasons why the document feeding speed fluctuates when each sheet of a document is advanced by driving a lower transfer roller and a lower discharge roller via a conventional gear-operated transmission mechanism.

A document feeding device shown in FIGS. 1A, 1B, 2A and 2B comprises a pair of upper and lower transfer rollers 13, 14 and a pair of upper and lower discharge rollers 15, 16, in which the upper transfer roller 13 is forced against the lower transfer roller 14 while the upper discharge roller 15 is forced against the lower discharge roller 16. In this document feeding device, driving force produced by a driving motor (not shown) is transmitted to the lower transfer roller 14 and the lower discharge roller 16 by way of a gear-operated transmission mechanism 23 which is composed essentially of a combination of multiple gears. More specifically, the driving force is transmitted to the lower transfer roller 14 via two gears 19, 24 and to the lower discharge roller 16 via two gears 20, 25.

Figure 1B:
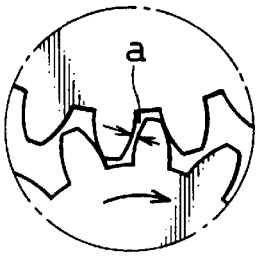
Figure 2A:
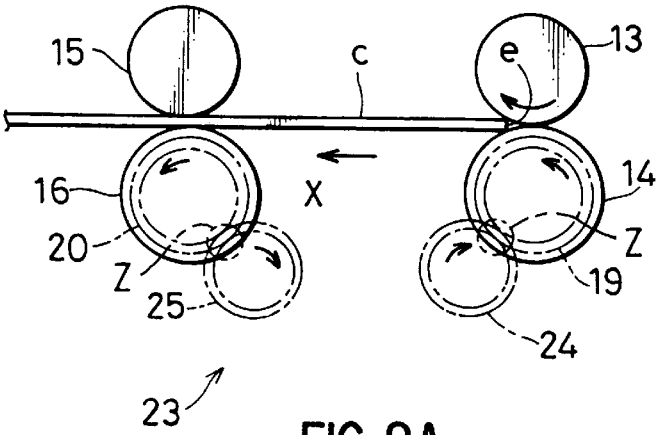
FIGS. 2A and 2B are diagrams illustrating how backlash in a reverse direction occurs in the conventional gear-operated transmission mechanism with FIG. 2B being an enlarged view of the area within the broken line circles Z in FIG. 2A.
Figure 2B:
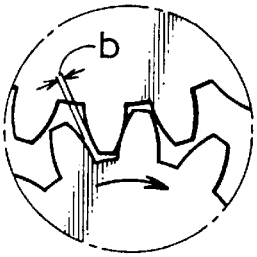

When the driving force is transmitted to the lower transfer roller 14 and the lower discharge roller 16 via the gear-operated transmission mechanism 23, there occurs a specific amount of backlash a between the gears 19 and 24 connected to the lower transfer roller 14 and between the gears 20 and 25 connected to the lower discharge roller 16 as shown in FIGS. 1A and 1B. The lower transfer roller 14 and the lower discharge roller 16 can therefore overrun by this amount of backlash a in their forward turning direction. Immediately before a rear end of a sheet c of the document leaves the transfer rollers 13, 14 as shown in FIGS. 2A and 2B, the upper transfer roller 13 which is forced against the lower transfer roller 14 exerts a strong pushing force on the rear end e of the sheet c, accelerating the sheet c in its forward (or downstream) direction. In a case where the sheet c is transported downward from the transfer rollers 13, 14, the forward-pushing force exerted by the upper transfer roller 13 on the rear end e of the sheet c becomes particularly large.

A combined effect of this forward-pushing force acting on the rear end e of the sheet c and the aforementioned backlash between engaging gear teeth is that the document feeding speed momentarily increases immediately before the rear end e of the sheet c leaves the transfer rollers 13, 14. Immediately after the rear end e of the sheet c has left the transfer rollers 13, 14, the lower discharge roller 16 stops to rotate for a short period of time corresponding to the amount of backlash b in a reverse direction (FIGS. 2A and 2B), resulting in a momentary decrease in the feeding speed of the sheet c.

If the driving motor employed in the document feeding device is a stepping motor, fluctuations in the document feeding speed may become more conspicuous. This is because the gears 24 and 25 of the gear-operated transmission mechanism 23 could momentarily stop in erratic pulsating motions depending on the timing with which the rear end e of the sheet c leaves the transfer rollers 13, 14 if the document feeding speed is set to a relatively low value.

On the basis of the foregoing discussion of the fluctuations in the document feeding speed, an arrangement for maintaining a constant document feeding speed in a facsimile machine, for example, will now be described.

B. General Construction of Facsimile Machine

Figure 3:
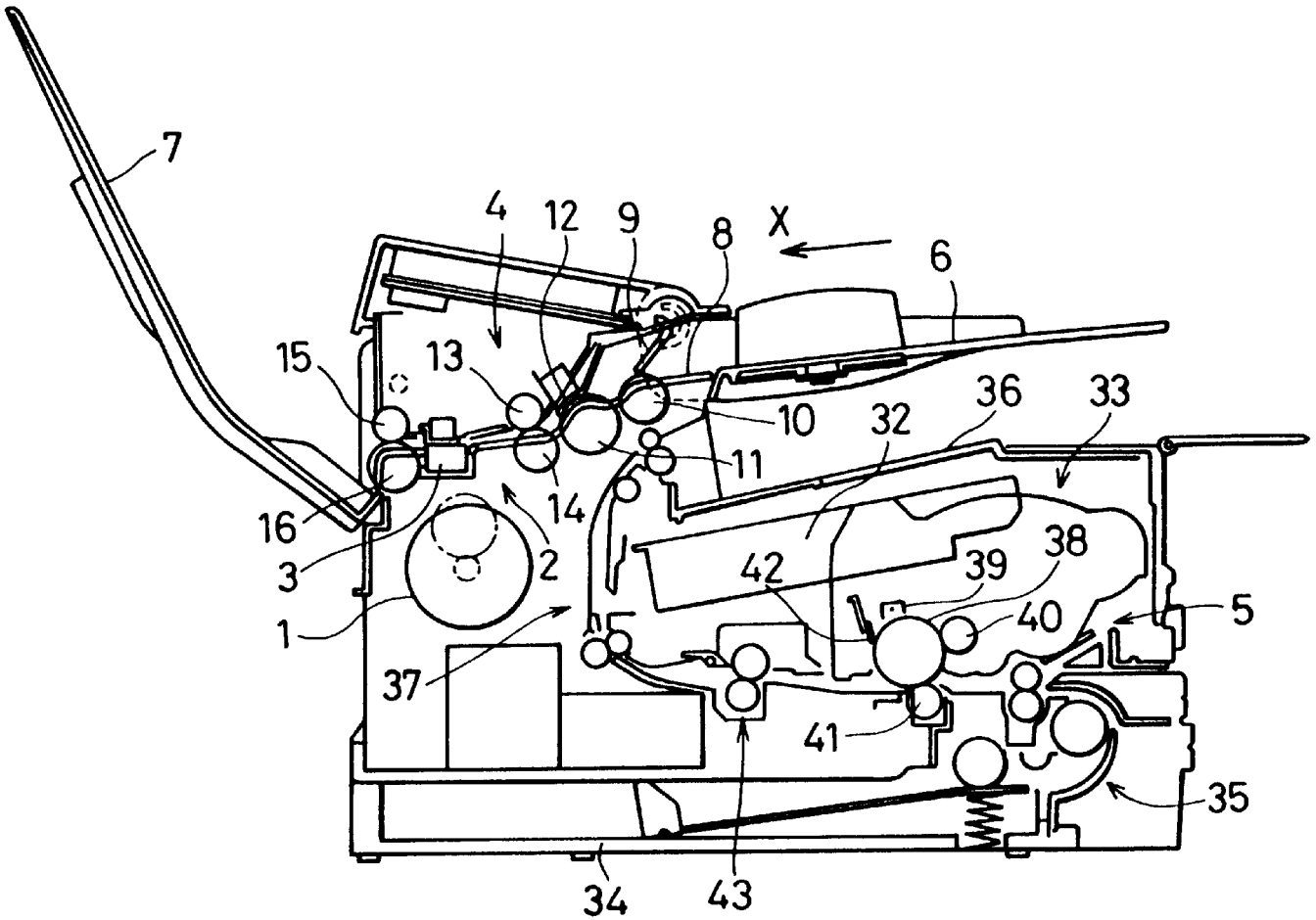
FIG. 3 is a diagram generally illustrating the construction of a facsimile machine comprising a document feeding device according to a preferred embodiment of the invention.

FIG. 3 is a diagram generally illustrating the construction of a facsimile machine according to a preferred embodiment of the present invention. This facsimile machine comprises an image scanning/transmitting unit 4 which transmits an image scanned by an internal image scanner including a document feeding device 2, and a printing device 5 which reproduces a received image on a suitable type of paper.

Figure 4:
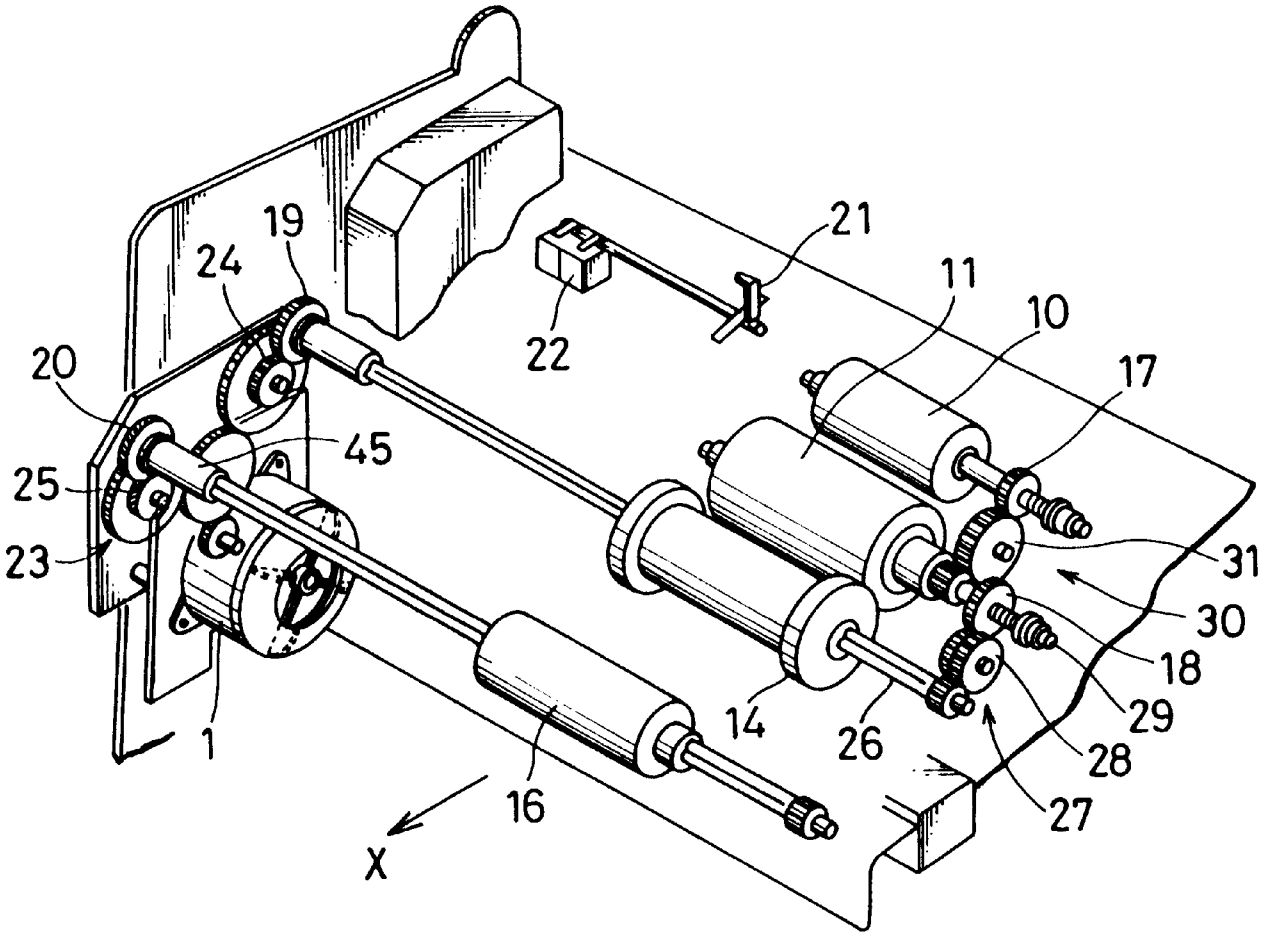
FIG. 4 is a perspective diagram illustrating a principal portion of the document feeding device.

Provided with a guide plate 8 for guiding an original document, the document feeding device 2 feeds the document placed on a document feeder tray 6 in a document feed direction marked by X in FIG. 3 and ejects the document onto a transmitted document recovery tray 7. An input roller 10 associated with a document squeezer plate 9, a feed roller 11 associated with a separation pad 12, a pair of transfer rollers 13, 14, and a pair of discharge rollers 15, 16 are provided along the guide plate 8 from its upstream end (right side in FIG. 3) to downstream end (left side in FIG. 3) with respect to the document feed direction X in this order. As illustrated in FIG. 4, the rollers 10, 11, 14 and 16 are equipped with gears 17, 18, 19 and 20, respectively, which constitute part of gear-operated transmission mechanisms. The document feeding device 2 further includes a stepping motor 1 which produces driving force for rotating these rollers 10, 11, 14 and 16. The gear-operated transmission mechanisms will be described later in greater detail. When the document is placed on the document feeder tray 6, a sensor arm 21 is pressed by the document and this causes a switch 22 to turn on.

As shown in FIG. 3, the internal image scanner includes, in addition to the document feeding device 2, an image reading device 3 located between the lower transfer roller 14 and the lower discharge roller 16 for sequentially scanning an image on each sheet of the document as it is transported by the document feeding device 2 in the document feed direction X. More particularly, the document placed on the document feeder tray 6 is transported toward the image reading device 3 between the input roller 10 and the document squeezer plate 9 and between the feed roller 11 and the separation pad 12. An original image on the document is scanned as it passes through the image reading device 3, and a resultant image signal is transmitted to a receiving facsimile machine. Each sheet of the transmitted document is ejected onto the transmitted document recovery tray 7.

The printing device 5 comprises an optical unit 32 which converts a received image signal representative of an original document into an electric signal or an optical signal and outputs the converted signal, an imaging unit 33, a paper feeding unit 35 which feeds each sheet of paper from a paper cassette 34 to the imaging unit 33, and a discharge unit 37 which delivers each sheet of paper carrying a reproduced image onto an output tray 36. The imaging unit 33 includes a static charger 39, a developing roller 40, an image transfer roller 41 and a drum cleaner 42 which are all arranged around a photosensitive drum 38. When an incoming image signal is received, it is converted into an electric signal or an optical signal by the optical unit 32 and a latent image derived from the converted signal is formed on a curved surface of the photosensitive drum 38. The developing roller 40 develops the latent image to produce a toner image on the surface of the photosensitive drum 38. As a sheet of paper fed from the paper cassette 34 passes over the image transfer roller 41, the toner image is transferred onto the sheet. The sheet of paper carrying the toner image is peeled off the photosensitive drum 38, and the toner image is fixed onto the sheet as it passes through a fixing roller asembly 43. The sheet of paper is eventually ejected onto the output tray 36 through the discharge unit 37.

This facsimile machine can also be used for producing copies of an original document. This is performed in a manner described below. As a sheet of the document placed on the document feeder tray 6 passes through the image reading device 3 located between the rollers 14 and 16 in the same way as discussed above, an original image on the sheet is scanned by the image reading device 3. The sheet of the document already scanned is ejected onto the transmitted document recovery tray 7. On the other hand, an image signal obtained in the scanning process is used to produce a latent image on the surface of the photosensitive drum 38. The latent image is developed into a toner image, which is then transferred and fixed onto a sheet of paper fed from the paper cassette 34. The sheet of paper carrying a reproduced image is eventually ejected onto the output tray 36 through the discharge unit 37.

C. Document Feeding Device

Figure 5:
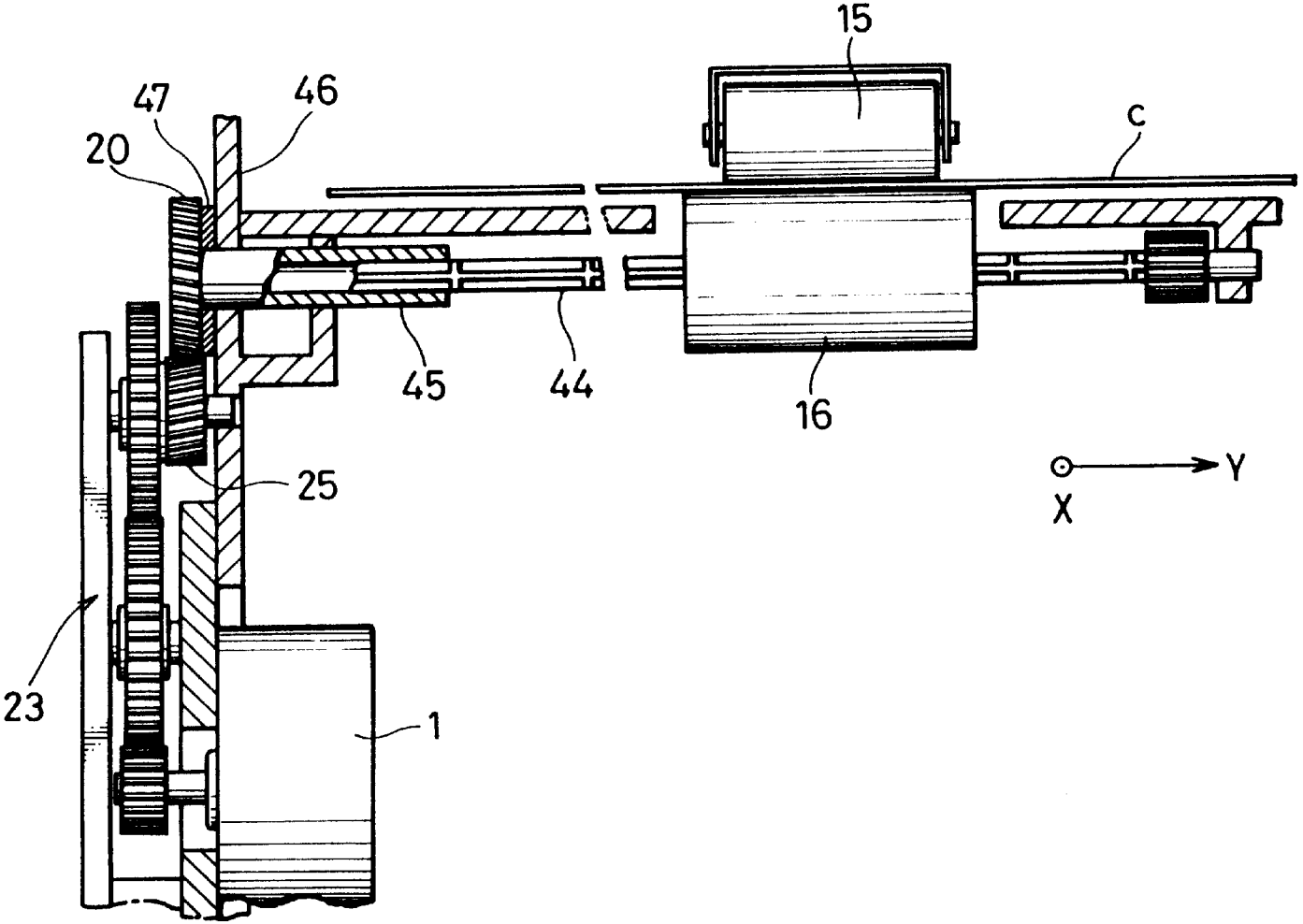
FIG. 5 is a front view of the document feeding device as observed from a downstream side along a document feed direction marked by X in FIG. 4.

FIG. 4 is a perspective diagram illustrating principal components of the document feeding device 2, and FIG. 5 is a front view of the document feeding device 2 as observed from a downstream side along the document feed direction marked by X in FIG. 4. As can be recognized from the construction of the document feeding device 2 shown in FIG. 4, the stepping motor 1 provides driving force to a first gear-operated transmission mechanism 23 which comprises gears 24 and 25 as well as the earlier-mentioned gears 19 and 20 to rotate the lower transfer roller 14 and the lower discharge roller 16. A second gear-operated transmission mechanism 27 which comprises a plurality of gears including an intermediate gear 28 is provided between the feed roller 11 and the lower transfer roller 14, wherein the feed roller 11 is caused to revolve when the lower transfer roller 14 rotates. In addition, a third gear-operated transmission mechanism 30 which comprises a plurality of gears including an intermediate gear 31 is provided between the input roller 10 and the feed roller 11, wherein the input roller 10 is caused to revolve when the lower feed roller 11 rotates.

Among the gears constituting the first gear-operated transmission mechanism 23, the driver gear 20 is mounted on a roller shaft 44 of the lower discharge roller 16 by way of a boss 45 and the driven gear 25 which engages the driver gear 20 are helical gears while the other gears of the first gear-operated transmission mechanism 23 are spur gears as shown in FIG. 5. The roller shaft 44 has an odd-shaped cross section, such as a cruciform. The boss 45 is mounted at one end of the roller shaft 44 in such a way that the boss 45 can slide in an axial direction Y, and the driver gear 20 is firmly fixed to the boss 45. In this embodiment, the roller shaft 44 of the lower discharge roller 16 is supported by a bracket 46 via the boss 45 at one end and by an appropriate supporting member at the other end so that the discharge roller 16 can rotate relative to the bracket 46. Directions of individual teeth of the helical gears 20 and 25 are so arranged that the helical gear 20 connected to the lower discharge roller 16 shifts in the axial direction Y toward the bracket 46 when the stepping motor 1 is activated.

Figure 6:
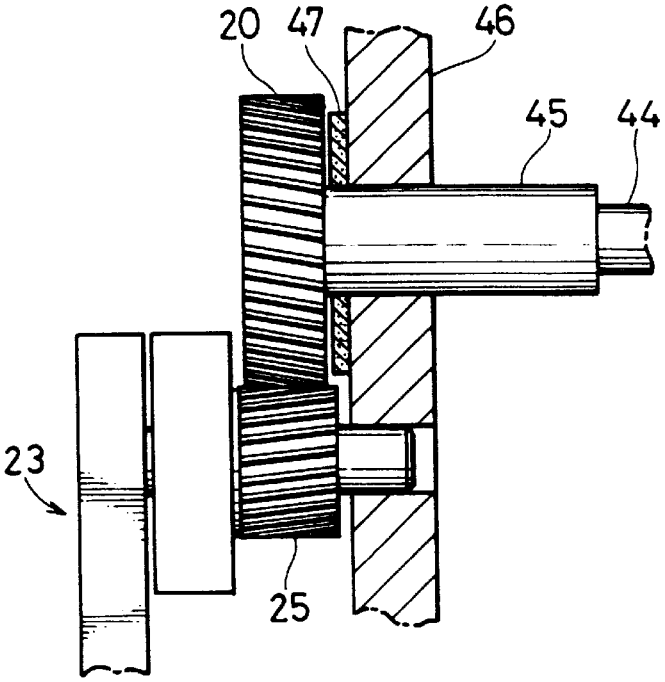
FIGS. 6 and 7 are fragmentary front views illustrating the operation of a gear-operated transmission mechanism of the document feeding device of FIG. 4.
Figure 7:
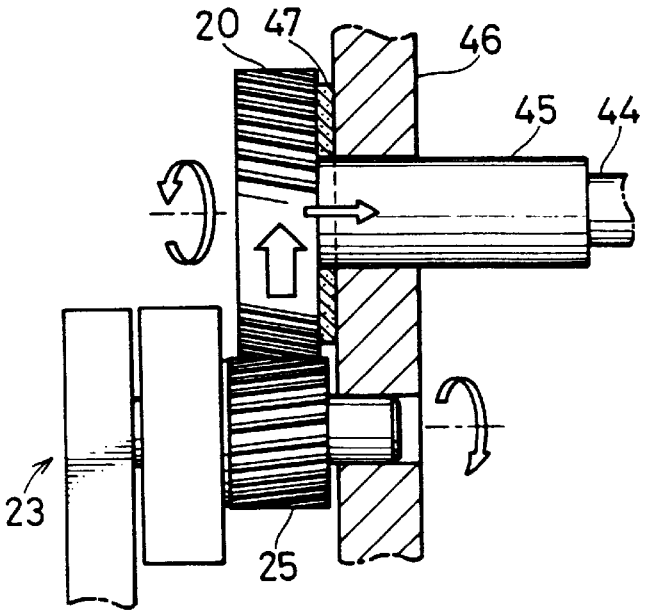

A friction pad 47 formed from felt or sponge rubber, for example, is attached to an outer surface of the bracket 46 that comes face to face with an inner surface of the helical gear 20. As a result, a narrow clearance is created between the friction pad 47 and the inner surface of the gear 20 as shown in FIG. 6 when the stepping motor 1 is not running. When the stepping motor 1 is energized, however, the helical gear 20 connected to the lower discharge roller 16 shifts toward the bracket 46 and the inner surface of the gear 20 comes in sliding contact with the friction pad 47 as shown in FIG. 7. Resultant frictional resistance between the gear 20 and the friction pad 47 produces a braking force which acts on the rotating lower discharge roller 16.

Since the friction pad 47 exerts the braking force on the lower discharge roller 16 as described above, an overrun of the lower discharge roller 16 due to a backlash between the gears 20 and 25 is prevented even when the upper transfer roller 13 exerts a forward-pushing force on a rear end e of a sheet of the document. It is appreciated from the foregoing discussion that the document feeding device 2 effectively suppresses adverse effects of the forward-pushing force exerted on the rear end e of each sheet and makes it possible to feed the document at a constant speed.

In addition, since a thrusting force exerted by the driver gear 20 on the friction pad 47 is released when the stepping motor 1 is deenergized, it is possible to prevent the friction pad 47 from being deformed by a pressure applied to it by the driver gear 20.

D. Variations of the Preferred Embodiment

While the invention has so far been described with reference to one preferred embodiment thereof, various variations and alternatives are possible. For example, location of the friction pad 47 is not limited to what has been described in the foregoing embodiment. In one varied form of the invention, the friction pad 47 may be securely attached to the driver gear 20 in such a manner that a narrow clearance is created between the bracket 46 and the friction pad 47 when the stepping motor 1 is deenergized. Alternatively, the friction pad 47 may be simply fitted over the boss 45 so that the friction pad 47 is free to rotate relative to both the driver gear 20 and the bracket 46. In another varied form of the invention, the driver gear 20 may be integrally formed with, or securely assembled with, the lower discharge roller 16 at one end thereof with a sliding member having a disklike shape, for instance, mounted at the other end of the discharge roller 16. In this varied form, directions of individual teeth of the helical gears 20 and 25 are so arranged that the lower discharge roller 16 shifts in the axial direction Y illustrated in FIG. 5 when the stepping motor 1 is activated, and the friction pad 47 is located between the sliding member and a facing surface of a second bracket so that a narrow clearance is created between them to produce a braking force similar to that of the earlier-described preferred embodiment.

In still another varied form of the invention, the driver gear 19 connected to the lower transfer roller 14 and the driven gear 24 of the first gear-operated transmission mechanism 23 that engages the driver gear 19 may be constructed in a similar way to the driver gear 20 and the driven gear 25 and provided with a friction pad to produce a supplementary braking force which acts on the rotating lower transfer roller 14. This braking force should be of such a level that an increase in frictional resistance does not adversely affect normal running of the stepping motor 1. This construction prevents not only an overrun of the lower discharge roller 16 due to the backlash between the gears 20 and 25 but also the occurrence of the forward-pushing force exerted by the upper transfer roller 13 on the rear end e of each sheet of the document. It is therefore possible to stabilize the document feeding speed even more effectively.

Figure 8:
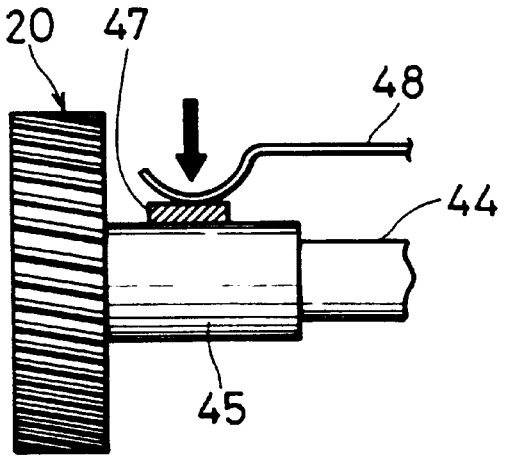
FIGS. 8 to 10 are fragmentary front views showing variations of the preferred embodiment.
Figure 9:
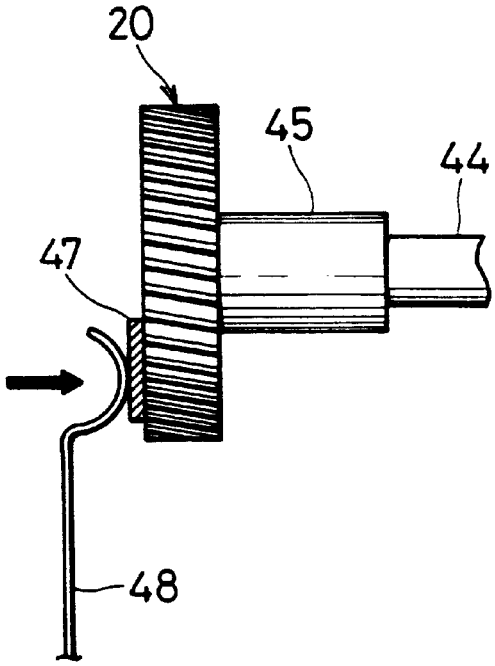
Figure 10:
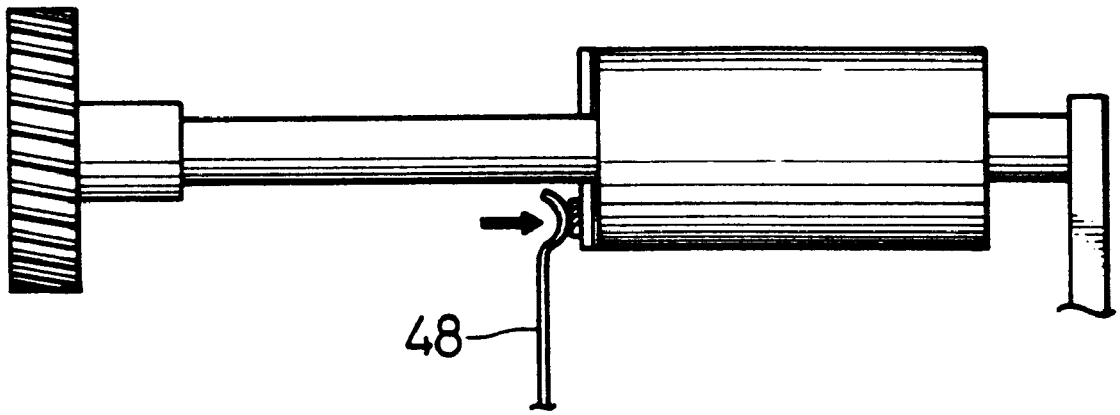

In the earlier-described preferred embodiment, the driver gear 20 is normally held free of the friction pad 47, and is pressed against the friction pad 47 to produce the braking force only when it is necessary. This is made possible in the foregoing embodiment by using the shifting of the helical gear 20 in its axial direction. Alternatively, a friction pad 47 attached to an end of a spring 48 as shown in FIG. 8 may be slidably pressed against the roller shaft 44 in continuous contact. In this alternative arrangement, a braking force is produced due to frictional resistance between the friction pad 47 and the rotating roller shaft 44. This arrangement may be so modified that the friction pad 47 is pressed against the boss 45 instead of the roller shaft 44 (FIG. 8). Shown in FIGS. 9 and 10 are other alternative arrangements, in which a friction pad 47 attached to an end of a spring 48 is slidably pressed against an outer surface of the gear 20 or against an end surface of the lower discharge roller 16 itself to produce a braking force. In any of these alternative arrangements (FIGS. 8 to 10), the gears 20 and 25 need not be helical gears. It is apparent that the lower transfer roller 14 may be provided with a similar arrangement to produce a supplementary braking force.

Even if the document feeding device 2 is so constructed that the driving force produced by the stepping motor 1 is transmitted to the upper transfer roller 13 and the upper discharge roller 15 via a gear-operated transmission mechanism, it is possible feed each sheet of the document at a constant feeding speed by producing a braking force acting at least on the upper discharge roller 15 with an arrangement similar to the preferred embodiment or its variations described above.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A document feeding device for an image reading apparatus having an image reader for scanning an image on an original document while it is being transported in a specific feed direction, said document feeding device comprising:

first and second transfer rollers arranged in parallel with each other in mutual contact on an upstream side of said image reader;

first and second discharge rollers arranged in parallel with each other in mutual contact on a downstream side of said image reader;

a driver serving as a source of driving force for rotating said first transfer roller and said first discharge roller;

a gear-operated transmission mechanism including a plurality of gears for transmitting the driving force produced by said driver to said first transfer roller and said first discharge roller; and an anti-rotation brake for exerting a braking force on said first discharge roller.

2. A document feeding device as defined in claim 1 wherein said second discharge roller is located on top of said first discharge roller, said second discharge roller being pressed against said first discharge roller.

3. A document feeding device as defined in claim 1 wherein said anti-rotation brake exerts a braking force on said first transfer roller as well.

4. A document feeding device as defined in claim 1 wherein said gear-operated transmission mechanism includes a helical gear which is made movable relative to said first discharge roller in its axial direction, wherein anti-rotation brake includes a friction element, and wherein said helical gear shifts in the axial direction when said gear-operated transmission mechanism begins to transmit the driving force of said driver to said first discharge roller, and said friction element exerts its braking force on said first discharge roller.

5. A document feeding device as defined in claim 4 wherein said friction element is fixed in a shifting direction of said helical gear so that said helical gear comes in sliding contact with said friction element when said helical gear shifts in its axial direction.

6. A document feeding device as defined in claim 4 further comprising a bracket for rotatably supporting said first discharge roller, wherein said friction element is fixed to said helical gear and comes in sliding contact with said bracket when said helical gear shifts in its axial direction.

7. A document feeding device as defined in claim 4 further comprising a bracket for rotatably supporting said first discharge roller, wherein said friction element is located between said helical gear and said bracket, and is sandwiched between said helical gear and said bracket when said helical gear shifts in its axial direction.

8. A document feeding device as defined in claim 4 further comprising a bracket for rotatably supporting said first discharge roller and a sliding member connected to said first discharge roller, wherein said sliding member moves together with said first discharge roller in its axial direction when said helical gear shifts in the axial direction, whereby said friction element is sandwiched between said sliding member and said bracket.

9. A document feeding device as defined in claim 1 wherein said anti-rotation brake includes a friction element for producing frictional resistance which acts on said first discharge roller.

10. A document feeding device as defined in claim 9 wherein said friction element is brought into sliding contact with said first discharge roller or with its rotating shaft.

11. A document feeding device as defined in claim 9 wherein said friction element is brought into sliding contact with part of said gear-operated transmission mechanism.

* * * * *